US008113886B2

(12) United States Patent
Jung et al.

(10) Patent No.: US 8,113,886 B2
(45) Date of Patent: Feb. 14, 2012

(54) MEMORY CARD MOUNTING DEVICE FOR PORTABLE TERMINAL

(75) Inventors: Min-Su Jung, Seoul (KR); Kwang-Jin Bae, Gyeongsangbuk-do (KR); Jung-Nam Moon, Incheon (KR); Hong-Moon Chun, Gyeonggi-do (KR)

(73) Assignee: Samsung Electronics Co., Ltd., Maetan-Dong, Yeongtong-Gu, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 12/858,576

(22) Filed: Aug. 18, 2010

(65) Prior Publication Data

US 2011/0092087 A1 Apr. 21, 2011

(30) Foreign Application Priority Data

Oct. 15, 2009 (KR) ..... 10-2009-0098313

(51) Int. Cl.
*H01R 24/00* (2006.01)

(52) U.S. Cl. ..... 439/630

(58) Field of Classification Search ..... 439/630, 439/218, 159

See application file for complete search history.

(56) References Cited

U.S. PATENT DOCUMENTS

| | | | | |
|---|---|---|---|---|
| 7,530,852 | B2 * | 5/2009 | Hu et al. | 439/630 |
| 7,802,727 | B1 * | 9/2010 | Tsai | 235/483 |

FOREIGN PATENT DOCUMENTS

| | | |
|---|---|---|
| KR | 2005-89577 | 9/2005 |
| KR | 2006-13436 | 2/2006 |
| KR | 2006-63225 | 6/2006 |
| KR | 2009-63033 | 6/2009 |

* cited by examiner

*Primary Examiner* — Phuong Dinh

(74) *Attorney, Agent, or Firm* — Cha & Reiter, LLC

(57) ABSTRACT

Provided is a memory card mounting device for a portable terminal, the memory card mounting device including a first socket installed in the terminal in a state where an opening through which a memory card is inserted is positioned on a side surface of the terminal and a second socket installed in a form stacked on the first socket, in which an opening of the second socket through which a memory card is inserted is positioned in parallel to the opening of the first socket on the side surface of the terminal, or the second socket is positioned on a rear surface of the terminal such that the memory card is mounted in the second socket on the rear surface of the terminal. The opening through which the memory card is inserted can be positioned in various areas such as a side surface or a rear surface of the terminal.

20 Claims, 12 Drawing Sheets

MEMORY CARD MOUNTING DEVICE FOR PORTABLE TERMINAL

CLAIM OF PRIORITY

This application claims the benefit under 35 U.S.C. §119 (a) of a Korean Patent Application filed in the Korean Intellectual Property Office on Oct. 15, 2009 and assigned Serial No. 10-2009-0098313, the entire disclosure of which is hereby incorporated by reference.

BACKGROUND OF THE INVENTION

1. Field of the Invention

The present invention relates to a portable terminal, and more particularly, to a memory card mounting device for mounting an external memory card in a portable terminal.

2. Description of the Related Art

Generally, external memory cards are used to increase the storage capacity of an electronic terminal such as a mobile terminal, a Personal Digital Assistant (PDA), a digital camera, etc., and they are classified according to size and standard into a variety of formats including Secure Digital (SD), Multimedia Card (MMC), Compact Flash (CF), and memory stick.

Portable terminals can store downloaded multimedia files or files created by photographing in their internal memories. However, the built in memories have limited capacities, and also sharing of stored information with other devices is difficult to achieve unless the terminals are provided with a separate connection device. Moreover, as the quality of multimedia files and the performance of a photographing device has been improved in recent years, there is a need for increasing the storage capacity of the portable terminal.

A portable terminal is typically equipped with a socket for mounting an external memory card, and a micro SD card suitable for a miniaturized device such as a widely used mobile communication terminal. The common use of such a memory card mounting device as a socket and an improved-integration of external memory card increased the utilization of the portable terminal and improved the sharing of information stored in the portable terminal.

In case of a cellular phone, the terminal is evermore miniaturized with the development of more sophisticated electronic/communication technologies, while the size of a display device is increasing. However, the size of information stored in the terminal sharply increases with the enhancement of a multimedia file reproduction function and camera performance.

Although the storage capacity of a memory card is also increasing owing to the improvement in the integration of the memory card, there is still a limitation in accommodating such a card. Although much effort has been made to increase the number of sockets for memory card mounting, this type of mounting has drawbacks especially as the phone is becoming smaller and slimmer.

SUMMARY OF THE INVENTION

An aspect of the present invention is to address at least the above problems and/or disadvantages and to provide at least the advantages described below. Accordingly, an aspect of the present invention is to provide a memory card mounting device for a portable terminal, which can increase the number of sockets for mounting a memory card while minimizing an occupied mounting space.

According to an aspect of the present invention, there is provided a memory card mounting device for a portable terminal, the memory card mounting device including a first socket installed in the terminal in a state where an opening through which a memory card is inserted is positioned on a side surface of the terminal and a second socket installed in a form stacked on the first socket, in which an opening of the second socket through which a memory card is inserted is positioned in parallel to the opening of the first socket on the side surface of the terminal, or the second socket is positioned on a rear surface of the terminal such that the memory card is mounted in the second socket on the rear surface of the terminal.

The first socket and the second socket may allow the memory cards to be inserted thereinto or ejected therefrom in a push-lock/push-unlock way, and the opening of the second socket may be positioned in parallel to that of the first socket. Each of the first socket and the second socket may include a mounting recess for receiving the corresponding memory card and connection terminals installed on a bottom surface of the mounting recess, the first socket and the second socket may be coupled to each other, with the mounting recesses facing each other, and a separation plate may be further provided between the first socket and the second socket to separate the mounting recesses.

The second socket may include binding hooks extending from an edge thereof, the binding hooks being bound to the first socket to couple the second socket to the first socket.

The memory card mounting device may further include a cover coupled to a surface of the first socket, wherein the first socket may include an open mounting recess in a surface thereof, the opening may be provided in an end of the mounting recess, and the cover may be coupled to a surface of the first socket to close the mounting recess except for the opening of the first socket. The second socket is coupled to the cover on a surface thereof facing the cover and comprises a guide member pivotably coupled to the other surface thereof, the guide member opening or closing the other surface of the second socket by pivoting relative to the second socket.

The guide member may move toward or away from the rear surface of the terminal by pivoting relative to the second socket, the memory card may be inserted and fixed to the guide member when the guide member protrudes from the rear surface of the terminal, and the memory card inserted and fixed to the guide member may be received by the second socket when the guide member closes the other surface of the second socket.

The second socket may include a binding member which is fixed at both side ends thereof and is bound to the first socket to cover both side ends of the first socket, the second socket being coupled to the first socket through the bounding of the binding member to the first socket.

The opening of the second socket through which the memory card is inserted may be positioned on the rear surface of the terminal.

The insertion of the memory card into the second socket may be performed in a direction reverse to the insertion of the memory card into the first socket.

The second socket may further include a cover coupled to a surface thereof, the cover being fixed to the second socket by means of the binding member.

The second socket may be exposed on the rear surface of the terminal and may be closed by a battery cover coupled to the rear surface of the terminal.

BRIEF DESCRIPTION OF THE DRAWINGS

The above and other features and advantages of exemplary embodiments of the present invention will be more apparent from the following detailed description taken in conjunction with the accompanying drawings, in which.

DETAILED DESCRIPTION OF THE INVENTION

Hereinafter, exemplary embodiments of the present invention will be described in detail with reference to the accompanying drawings. For the purposes of clarity and to avoid redundancy, detailed descriptions of well-known functions and constructions are omitted for clarity and conciseness.

Figure 1:
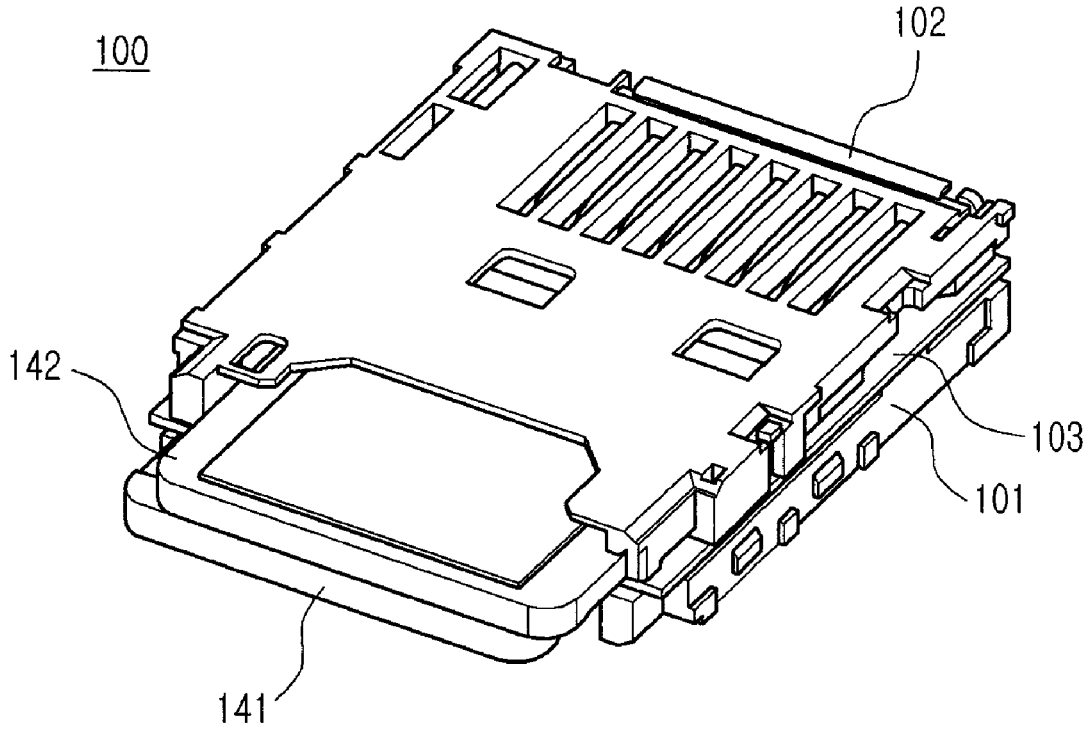
FIG. 1 is a perspective view of a memory card mounting device for a portable terminal according to a first embodiment of the present invention.
Figure 2:
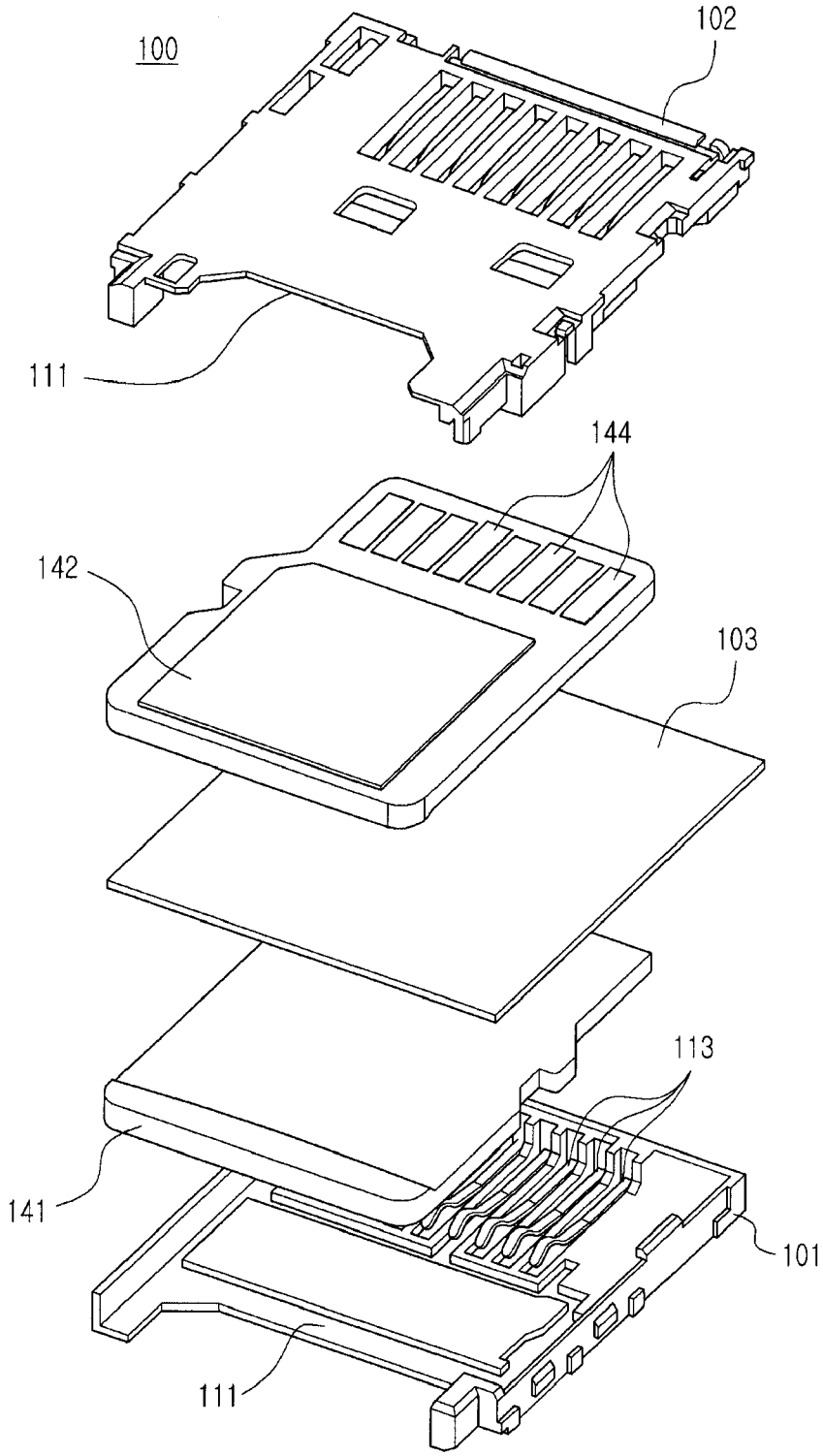
FIG. 2 is an exploded perspective view of the memory card mounting device shown in FIG. 1.
Figure 3:
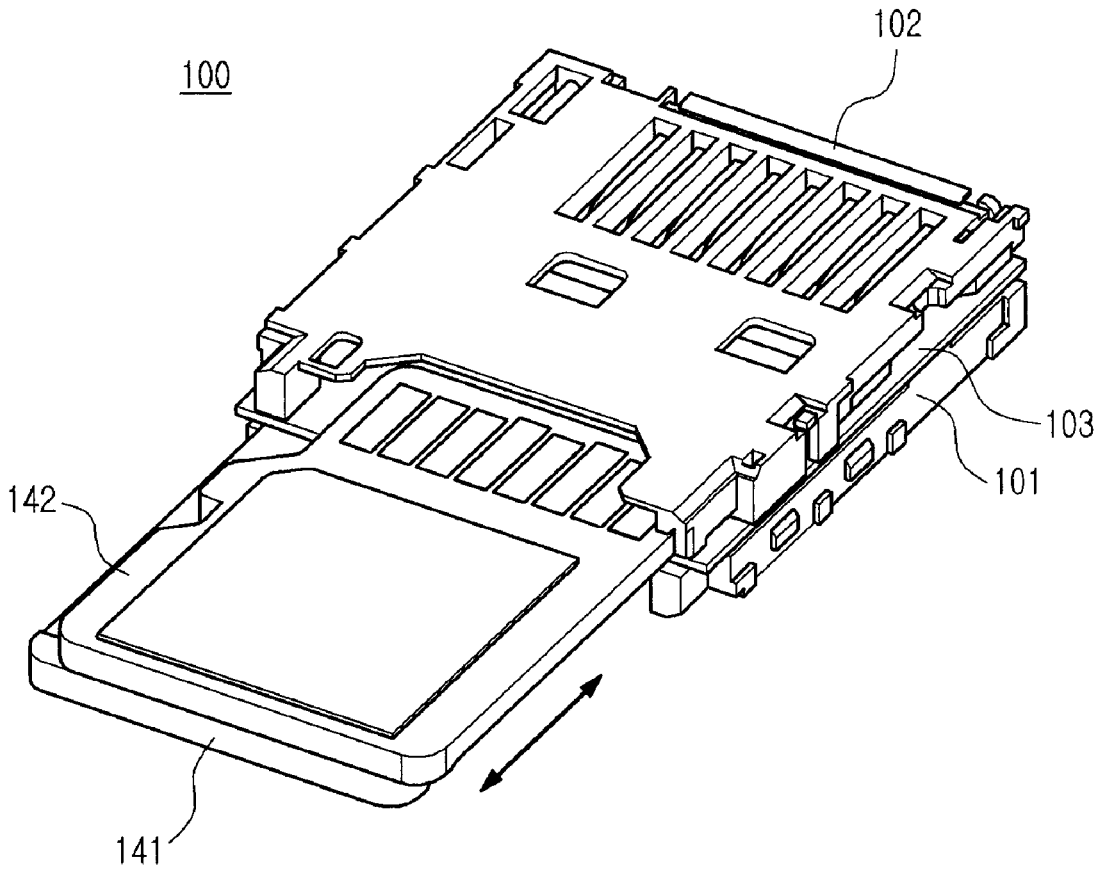
FIG. 3 is a view for explaining insertion/ejection of a memory card into/from the memory card mounting device shown in FIG. 1.

FIGS. 1 through 3 show a memory card mounting device 100 for a portable terminal according to a first embodiment of the present invention. As shown, the memory card mounting device 100 is structured such that a pair of first and second sockets 101 and 102 are coupled and stacked, facing each other. Memory cards 141 and 142 are inserted into the sockets 101 and 102 in parallel to each other in a state where respective contact terminals 144 of the memory cards 141 and 142 are oriented facing at opposite to each other.

The sockets 101 and 102 are in the same shape into and from which the memory cards 141 and 142 are slidably inserted and can be ejected via a push-lock/push-unlock motion. Each of the sockets 101 and 102 includes a mounting recess 111 being open to a surface thereof, such that the sockets 101 and 102 are coupled in a stacked state, with their open surfaces facing each other while a separation plate 103 being disposed between the socket 101 and 102. One end of the mounting recess 111 is maintained open, through which the memory cards 141 and 142 are inserted into the sockets 101 and 102, respectively.

Connection terminals 113 are provided on a bottom surface of the mounting recess 111, and each of the memory cards 141 and 142 is inserted through an opening provided at the one end of the mounting recess 111 such that its contact terminals 144 are electrically connected with the connection terminals 113.

The memory cards 141 and 142 inserted into the sockets 101 and 102 conform to the same size and spec, as shown in FIG. 3. They can be inserted into or ejected from the memory card mounting device 100 and position in parallel relationship to each other. The memory cards 141 and 142 may also be independently inserted into or ejected from the sockets 101 and 102.

When the above-structured memory card mounting device 100 is installed in the portable terminal, an opening through which a memory card is inserted is provided at one end of the portable terminal surface. Thus, depending on the orientation at one end of the portable terminal, the memory card can slidably inserted into or ejected from the memory card mounting device 100 along the lengthwise direction or widthwise direction of the terminal.

Although not shown in FIGS. 1 to 3, the memory card mounting device 100 preferably binds the sockets 101 and 102 by using a separate case or binding device. A cover 219 shown in FIG. 5 may be useful in binding the sockets 101 and 102. That is, in FIG. 5, the cover 219 is bound to both side surfaces of the sockets. In such a cover structure, if the cover 219 is bound to both side surfaces of the second socket 102 while covering a closed surface and both side surfaces of the first socket 101, the sockets 101 and 102 can be bound to each other. That is, if the cover 219 had a hook which is similar to a binding hook 223, and if the hook provided to the cover 219 can bind to both side surfaces of the second socket 102, the cover 219 can be bound the sockets 101 and 102.

As such, the memory card mounting device is structured by stacking sockets which allow insertion and ejection of memory cards on one side surface of the portable terminal, thereby easily doubling the information storage capacity of the portable terminal while reducing a mounting area occupied by the memory card mounting device.

Figure 4:
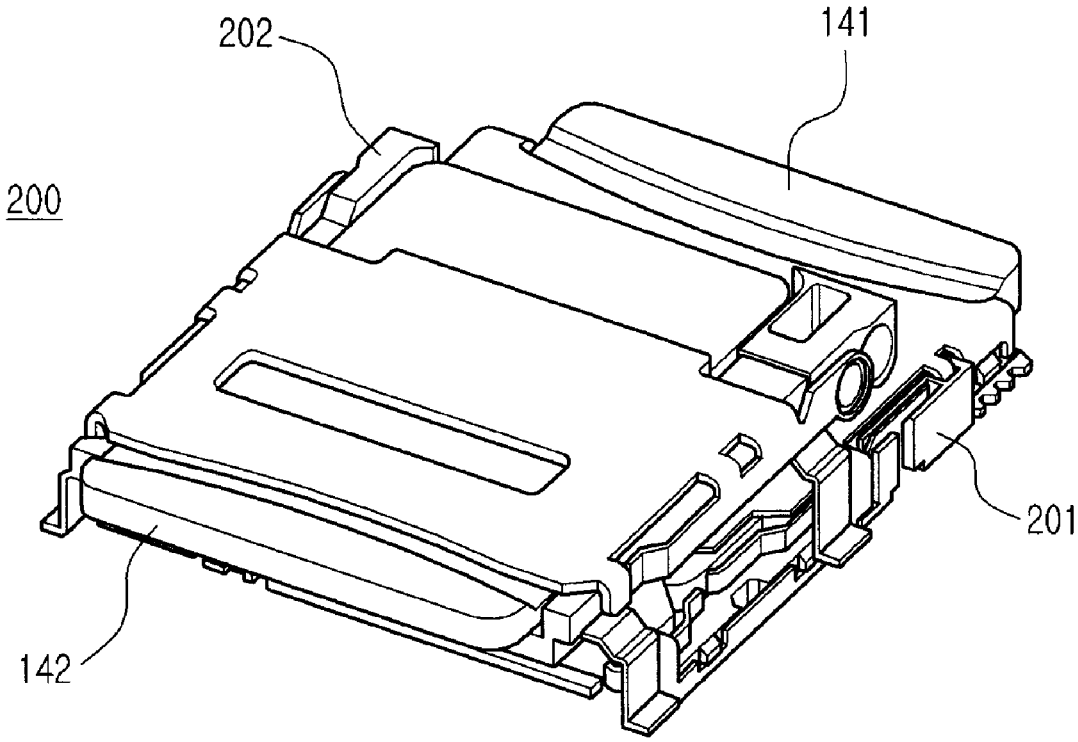
FIG. 4 is a perspective view of a memory card mounting device for a portable terminal according to a second embodiment of the present invention.
Figure 5:
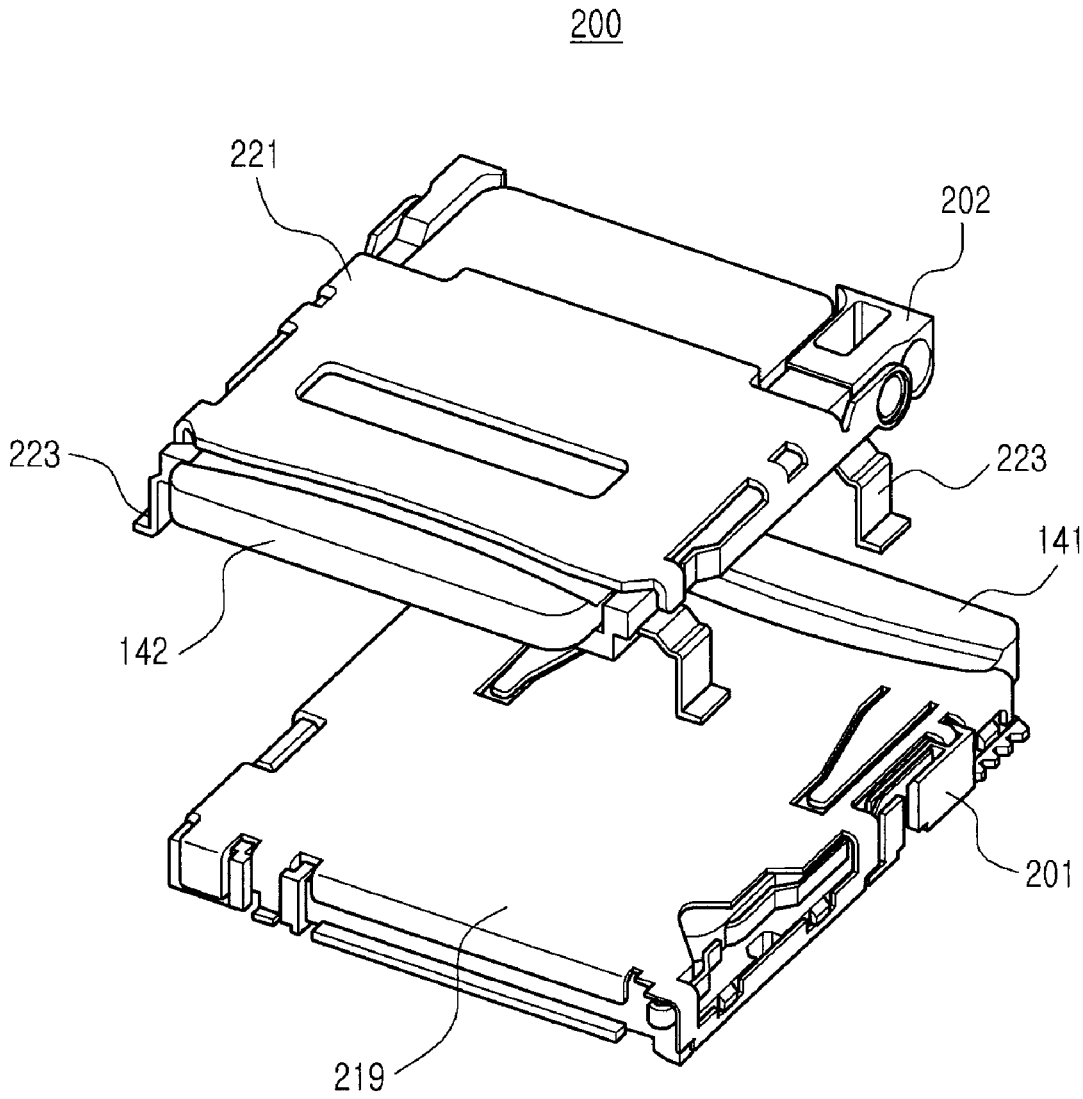
FIG. 5 is an exploded perspective view of the memory card mounting device shown in FIG. 4.
Figure 6:
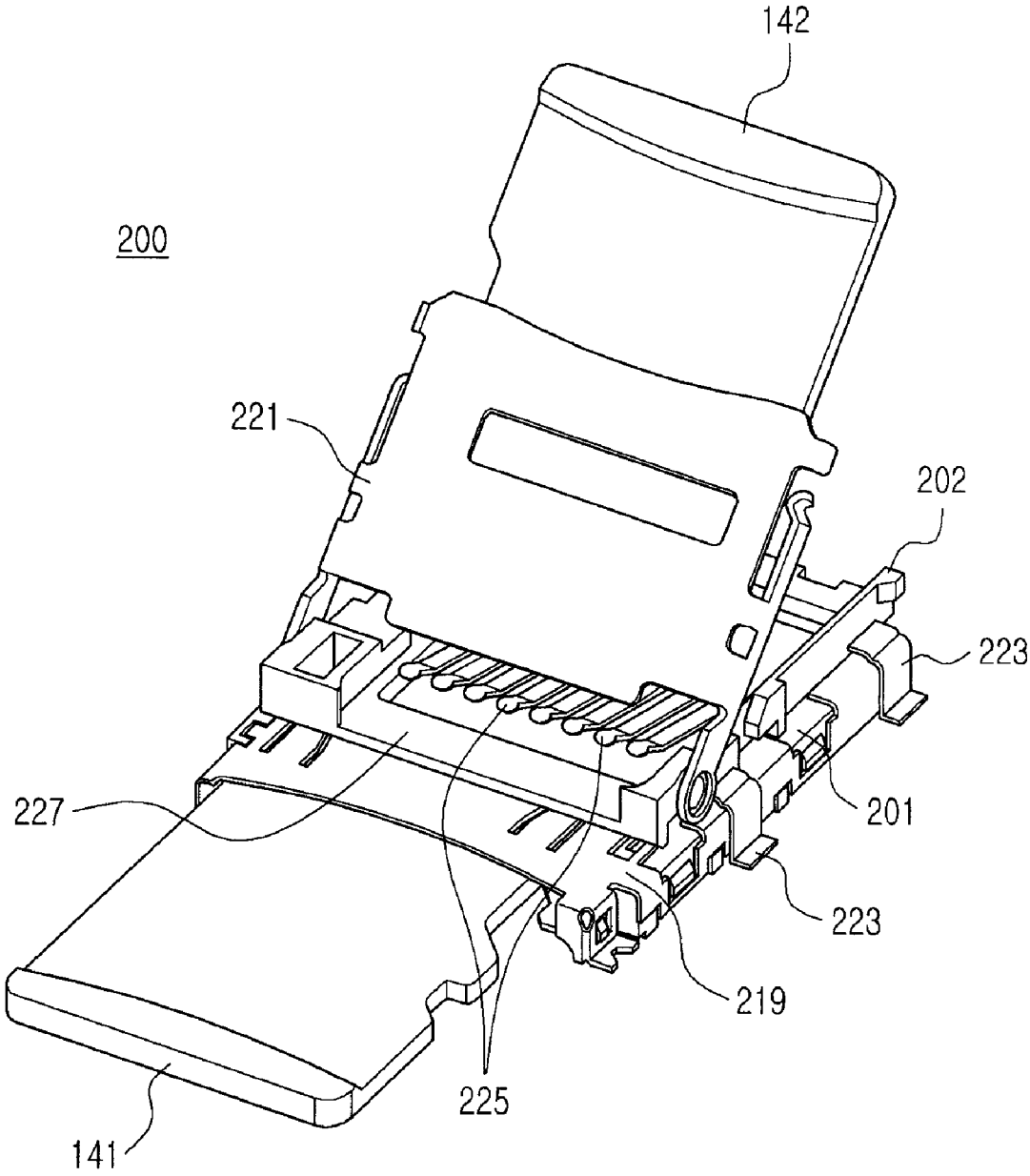
FIG. 6 is a view for explaining insertion/ejection of a memory card into/from the memory card mounting device shown in FIG. 4.

FIGS. 4 through 6 shows a memory card mounting device 200 for a portable terminal according to a second embodiment of the present invention. As shown, the memory card mounting device 200 is structured such that a pair of first and second sockets 201 and 202 is stacked facing each other and coupled to one of which a guide member 221 that is pivotably rotated.

The first socket 201 allows the memory card 141 to be inserted thereinto and ejected therefrom in a push-lock/push-unlock way, and includes a mounting recess (not shown) being open to a surface thereof. The cover 219 is mounted on the first socket 201 to close the mounting recess except for an opening through which the memory card 141 is inserted. As mentioned above, the cover 219 is bound to both side surfaces of the first socket 201 while covering a surface of the first socket 201.

The second socket 202 includes binding hooks 223 at both ends thereof. The binding hooks 223 are bound to the first socket 201 in a form covering both side surfaces of the first socket 201, thereby coupling the second socket 202 to the first socket 201.

The second socket 202 includes a mounting recess 227 being open to a surface thereof, and the guide member 221 is pivotably coupled to the second socket 202 to open or close the mounting recess 227 on the other surface of the second socket 202. The guide member 221 is structured to cover both side ends of the memory card 142, so that the member card 142 can be inserted and fixed to the guide member 221. When the guide member 221 closes the other surface of the second socket 202 in a state where the memory card 142 is inserted and fixed, the memory card 142 is completely received by the second socket 202, thus being connected to connection terminals 225 provided on the second socket 202.

The above-structured memory card mounting device 200 may be installed such that an opening of the first socket 201 is positioned on a side surface of the terminal, and the second socket 202 is positioned on a rear surface of the terminal. However, as long as a space allowing the memory card 141 to be inserted into and ejected from the first socket 201 can be secured, the first socket 201 can also be positioned on the rear surface of the terminal.

When the memory card mounting device 200 is installed such that the second socket 202 is positioned on the rear surface of the terminal, the guide member 221 moves toward or away from the rear surface of the terminal by pivoting relative to the second socket 202. When the guide member 221 protrudes from the rear surface of the terminal, the user can conveniently insert or eject the memory card 142 into or from the guide member 221.

Figure 7:
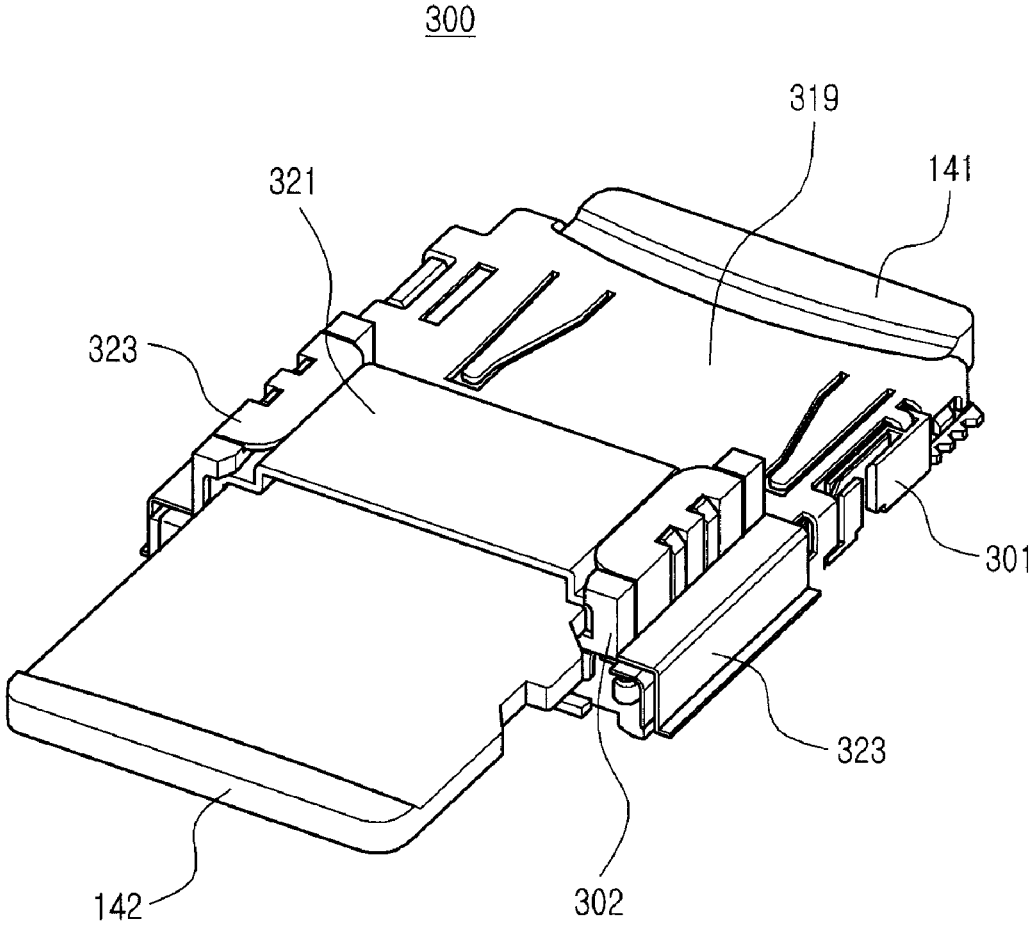
FIG. 7 is a perspective view of a memory card mounting device for a portable terminal according to a third embodiment of the present invention.
Figure 8:
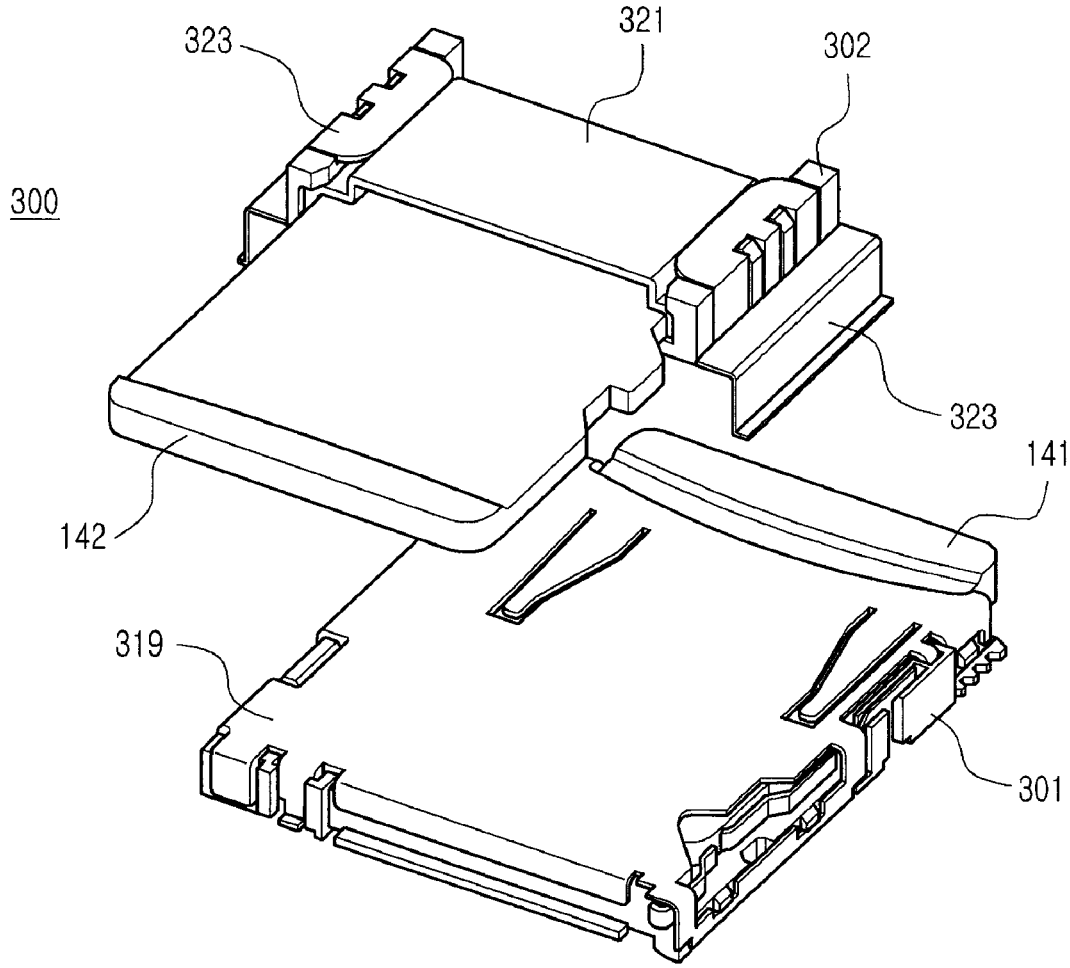
FIG. 8 is an exploded perspective view of the memory card mounting device shown in FIG. 7.
Figure 9:
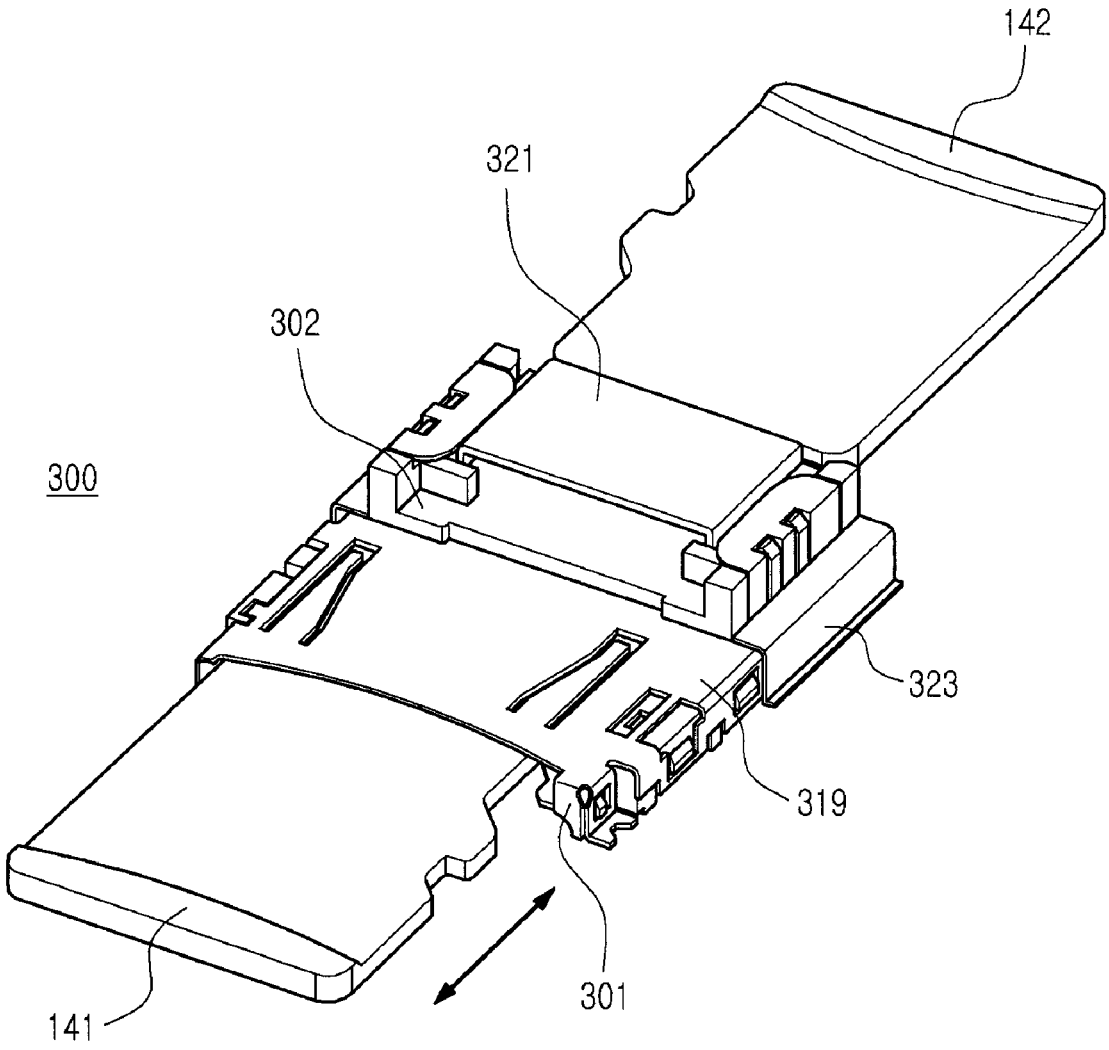
FIG. 9 is a view for explaining insertion/ejection of a memory card into/from the memory card mounting device shown in FIG. 7.

FIGS. 7 to 9 are views showing a memory card mounting device 300 for a portable terminal according to a third embodiment of the present invention. As shown, the memory card mounting device 300 is structured such that a pair of first and second sockets 301 and 302 is stacked next to each other.

The first socket 301 allows the memory card 141 to be slidably inserted thereinto and ejected therefrom in a push-lock/push-unlock way, and includes a mounting recess (not shown) being open to one surface thereof. A cover 319 is mounted on the first socket 301 to close the mounting recess except for an opening through which the memory card 141 is inserted. Similar to the second embodiment, the cover 319 is bound to both side surfaces of the first socket 301 while covering a surface of the first socket 301.

The second socket 302 forces the memory card 142 to be inserted thereinto or ejected therefrom, and is coupled to the first socket 301 by means of a separate binding member 323. The binding member 323 is installed on both side ends of the second socket 302 in a form covering the both side ends of the second socket 302 and, at the same time, the binding member 323 is also bound to the first socket 301 in a form covering both side ends of the first socket 301. In the third embodiment, the second socket 302 is installed in the opposite direction to the first socket 301. That is, as shown in FIG. 9, the insertion of the memory card 142 into the second socket 302 is performed in a direction reverse to the insertion of the memory card 141 into the first socket 301.

The second socket 302 is of a size for receiving only a portion of the memory card 142 in which contact terminals of the memory card 142 are installed, and may include a protection cover 321 for preventing the memory card 142 inserted into the second socket 302 from being separated from the second socket 302. The protection cover 321 may be maintained fixed to the second socket 302 by means of the binding member 323.

The above-described memory card mounting device 300 is structured such that the memory card 141 is inserted into or ejected from the first socket 301 in a push-lock/push-unlock way. Therefore, it is preferable that an opening through which the memory card 141 is inserted be positioned on a side surface of the terminal. The opening of the second socket 302 for inserting the memory card 142 is oriented opposite to that of the first socket 301. Considering the total size of a combination of the first socket 301 and the second socket 302, it can be seen that the opening of the second socket 302 cannot be positioned on a side surface of the terminal. Therefore, the second socket 302 is preferably positioned on the rear surface of the terminal.

As can be seen in FIGS. 7 and 9, even when the memory card 142 is inserted into the second socket 302 in the memory card mounting device 300 of the terminal, a space equal to the thickness of the first socket 301 is formed under the second socket 302. By using such a space, the terminal having the memory card mounting device 300 installed therein can be further provided with a space for mounting other parts.

Figure 10:
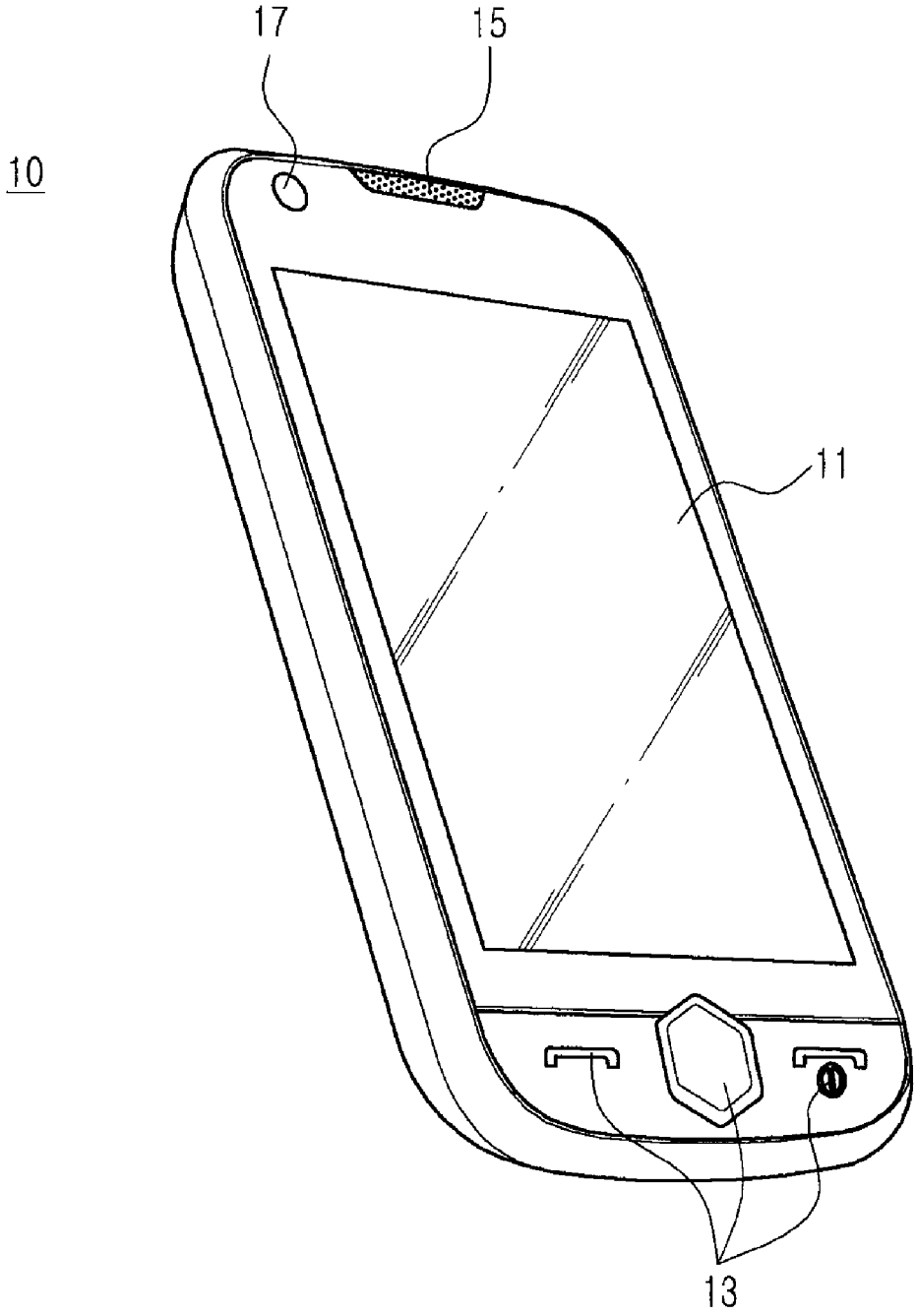
FIG. 10 is a perspective view of a portable terminal including a memory card mounting device according to the present invention.
Figure 11:
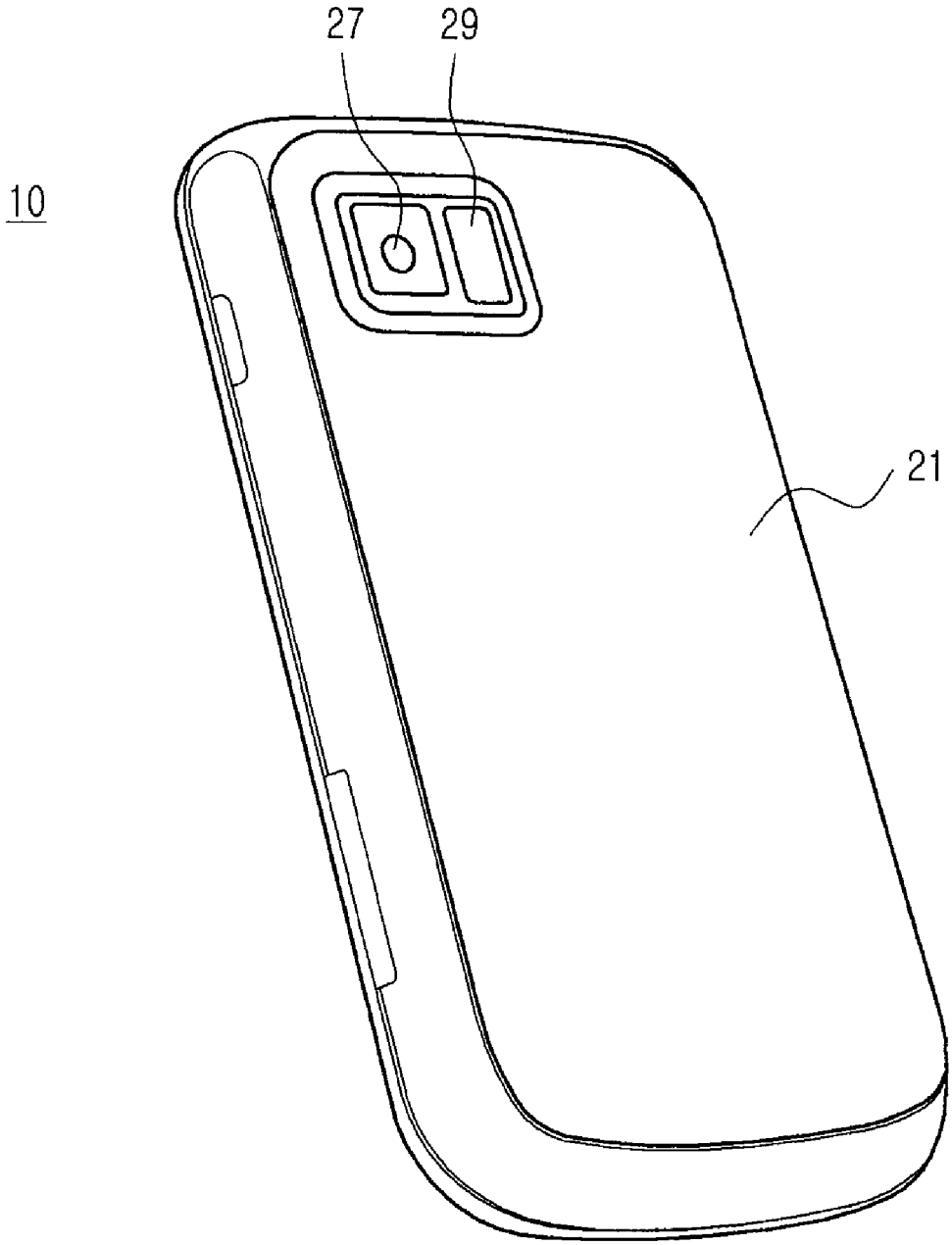
FIG. 11 is a perspective view of a rear surface of the portable terminal shown in FIG. 10.
Figure 12:
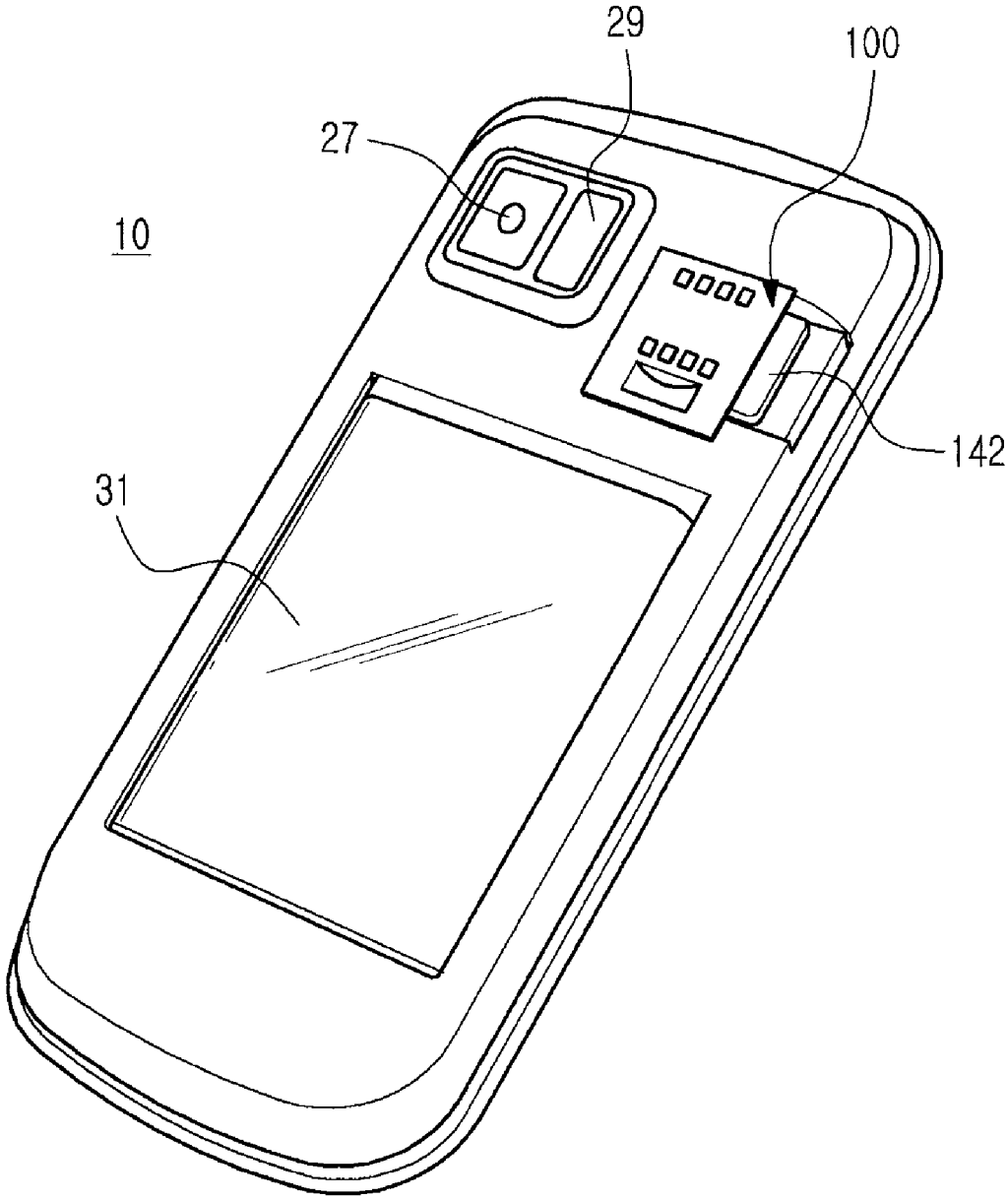
FIG. 12 is a perspective view showing that a battery cover of the portable terminal shown in FIG. 11 is removed.

FIGS. 10 through 12 show a portable terminal 10 having the memory card mounting device 100 installed therein according to the first embodiment of the present invention. The shown terminal 10 includes a display device 11 on a front surface thereof, a camera 17 and a receiving unit 15 (or earpiece) at an upper portion thereof, and a keypad 113 at a lower portion thereof. The camera 17 is used for users to perform video communication or to photograph themselves, and the receiving unit 15 outputs sound during voice communication or multimedia file reproduction. The keypad 13 includes a send button or navigation buttons. On a side surface of the terminal 10 may be installed a volume control button or a hot key for actuating the camera 17.

On a rear surface of the terminal 10 is mounted a battery pack 31 and may be installed another camera 27 for photographing an object and an illumination device 29. The terminal 10 may hide the battery pack 31 with a separate battery cover 21.

The memory card mounting device 100 is installed at a side of the camera 29 and the illumination device 29, and a portion thereof may be exposed on the rear surface of the terminal 10. The openings of the first socket 101 and the second socket 102 for memory card insertion are positioned on a side surface of the terminal in parallel to each other. The battery cover 21 is coupled to the rear surface of the terminal 10, thereby hiding the memory card mounting device 100 and the openings of the first socket 101 and the second socket 102 or the memory cards 141 and 142 inserted into the first socket 101 and the second socket 102.

As is apparent from the foregoing description, the memory card mounting device is structured such that two sockets are stacked, thereby facilitating an expansion of the information storage capacity of the terminal. In addition, the opening through which the memory card is inserted can be positioned in various areas such as a side surface or a rear surface of the terminal, thereby easily securing the mounting space on the terminal.

While the present invention has been shown and described with reference to embodiments thereof, it will be understood by those skilled in the art that various changes in form and details may be made therein without departing from the spirit and scope of the invention as defined by the appended claims.

What is claimed is:

1. A memory card mounting device for a portable terminal, comprising:

a first socket having an opening through which a first memory card having a plurality of first contact terminals is slidably inserted thereto; and a second socket having an opening coupled to the first socket, wherein the opening of the second socket through which a second memory card having a plurality of second contact terminals is slidably inserted is positioned in parallel to the opening of the first socket, and wherein the respective contact terminals of the first and second memory cards are oriented facing at opposite to each other when inserted in the respective socket.

2. The memory card mounting device of claim 1, wherein the first socket and the second socket allow the memory cards to be inserted thereinto or ejected therefrom in a push-lock/push-unlock fashion.

3. The memory card mounting device of claim 2, wherein each of the first socket and the second socket comprises a mounting recess for receiving the corresponding memory card and connection terminals installed on a bottom surface of the mounting recess with the mounting recesses facing each other.

4. The memory card mounting device of claim 1, further comprising a separation plate is provided between the first socket and the second socket.

5. The memory card mounting device of claim 1, wherein the second socket comprises binding hooks extending from an edge thereof, the binding hooks being bound to the first socket to couple the second socket to the first socket.

6. The memory card mounting device of claim 5, further comprising a cover coupled to a surface of the first socket, wherein the first socket comprises an open mounting recess in the surface thereof, the opening of the first socket is provided at an end of the mounting recess, and the cover is coupled to the surface of the first socket to close the mounting recess except for the opening of the first socket.

7. The memory card mounting device of claim 6, wherein the second socket is coupled to the cover on one surface thereof facing the cover and comprises a guide member pivotably coupled to the other surface thereof, the guide member opening or closing the other surface of the second socket by pivoting relative to the second socket.

8. The memory card mounting device of claim 7, wherein the guide member pivots and receives the second memory card.

9. The memory card mounting device of claim 1, wherein the second socket comprises a binding member which is fixed at both ends thereof and is bound to the first socket to cover both side ends of the first socket, the second socket being coupled to the first socket through the binding member to the first socket.

10. The memory card mounting device of claim 9, wherein the opening of the second socket through which the memory card is inserted is positioned on a rear surface of the terminal.

11. The memory card mounting device of claim 10, wherein the insertion of the memory card into the second socket is performed in a direction reverse to the insertion of the memory card into the first socket.

12. The memory card mounting device of claim 9, wherein the second socket further comprises a cover coupled to a surface thereof, the cover being fixed to the second socket by means of the binding member.

13. The memory card mounting device of claim 5, wherein the second socket is exposed on the rear surface of the terminal and is closed by a battery cover coupled to the rear surface of the terminal.

14. The memory card mounting device of claim 9, wherein the second socket is exposed on the rear surface of the terminal and is closed by a battery cover coupled to the rear surface of the terminal.

15. The memory card mounting device of claim 9, wherein the first socket is provided on a side surface of the terminal.

16. The memory card mounting device of claim 9, wherein the second socket is provided on a rear surface of the terminal.

17. The memory card mounting device of claim 9, wherein the second socket is provided on top of the first socket.

18. The memory card mounting device of claim 9, wherein the openings of the first and the second dockets are facing at opposite end.

19. The memory card mounting device of claim 9, wherein one end of the second socket is pivotally coupled to one end of the first socket.

20. The memory card mounting device of claim 1, wherein the respective contact terminals of the first and second memory cards are electrically coupled to connection terminals of the first and the second sockets.

* * * * *